United States Patent [19]

Joutsjoki

[11] 4,131,063

[45] Dec. 26, 1978

[54] CALENDER

[75] Inventor: Jukka Joutsjoki, Järvenpää, Finland

[73] Assignee: Oy Wartsila AB, Helsinki, Finland

[21] Appl. No.: 841,942

[22] Filed: Oct. 13, 1977

[30] Foreign Application Priority Data

Oct. 19, 1976 [FI] Finland ..... 762971

[51] Int. Cl.[2] ..... B30B 3/04

[52] U.S. Cl. ..... 100/162 R; 100/173

[58] Field of Search ..... 100/155, 160–176; 162/361, 362

[56] References Cited

U.S. PATENT DOCUMENTS 3,610,137 10/1971 Brafford ..... 100/161

3,905,288 9/1975 Holm ..... 100/173

FOREIGN PATENT DOCUMENTS 1086120 7/1960 Fed. Rep. of Germany ..... 100/162 R

*Primary Examiner*—Peter Feldman

*Attorney, Agent, or Firm*—Haseltine, Lake & Waters

[57] ABSTRACT

A calender comprising a plurality of superimposed hard rolls and a number of soft rolls arranged to load laterally a plurality of these hard rolls. The soft rolls are arranged in pairs formed by two soft rolls opposite each other at both sides of the same hard roll. The distance between the axes of the hard rolls located between a pair of soft rolls is greater than the sum of the radii of these hard rolls.

4 Claims, 4 Drawing Figures

CALENDER

Figure 1:
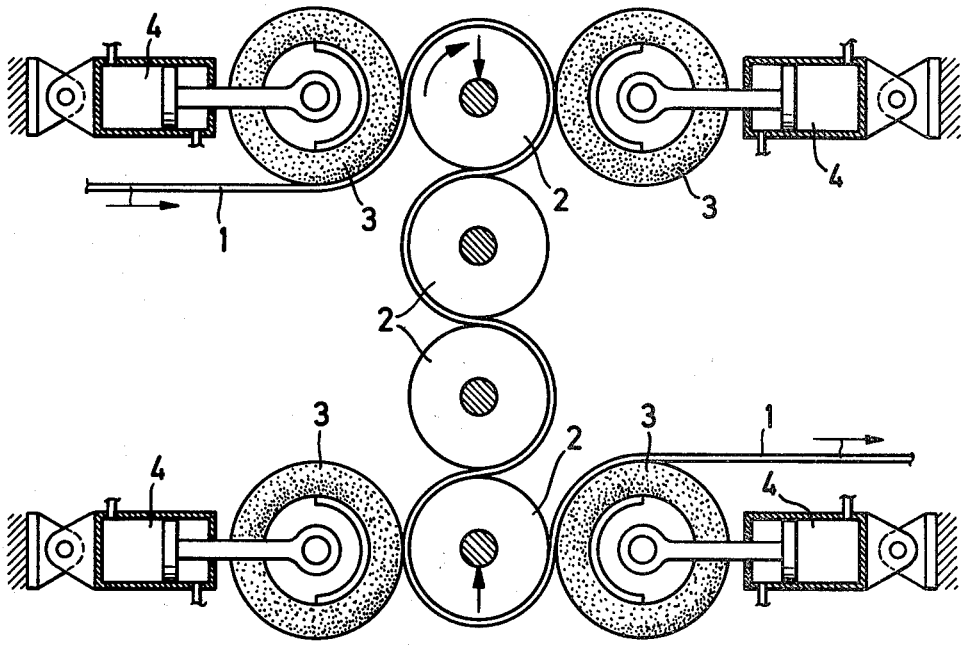

The invention relates to a calender comprising a plurality of hard rolls forming a roll stack and a number of soft rolls arranged to load some of said hard rolls from the side of the stack.

In Finnish patent application No. 3640/72 a calender is disclosed comprising a roll stack of four hard rolls, the two middle rolls of which are loaded each by a soft roll from opposite sides. This results in a lateral deflection of the middle rolls and in an uneven pressure distribution in the nip due to the deflection of the rolls. In the same application, also another embodiment is disclosed, in which the rolls loaded from the side have been moved somewhat to both sides of the plane of the roll stack in order to compensate for the deflecting forces by means of the pressure force applied to the roll stack. As a result, however, the line pressure between the middle rolls increases too much.

In addition to what has been described above an arrangement has been proposed, wherein soft rolls are arranged at both sides of two hard rolls so that they jointly prevent the hard rolls from deflecting laterally. This results in that the soft rolls have to be smaller in diameter than the hard rolls. As the soft rolls, due to the manufacturing technique applied, tend to be rather big, big hard rolls have to be used as well, whereby the nip pressure becomes too high due to the great weight of the rolls.

An object of the invention is to provide a calender, in which the lateral deflections can be eliminated but which is free from the drawbacks mentioned above. The invention is characterized in that the soft rolls are arranged in pairs opposite each other at both sides of the same hard roll, and that the distance between the axes of the hard rolls located between a pair of soft rolls is greater than the sum of the radii of these hard rolls. By this means lateral deflection of the rolls can in a simple way be prevented and, besides, an advantageous diameter ratio of the soft and the hard rolls is obtained.

The idea of the invention can be further developed so that the hard rolls are at least substantially in the same plane, and between the hard rolls located between a pair of soft rolls there are one or several hard rolls and between said hard rolls there is at least one hard nip. This arrangement is advantageous as to the size and operation of the calender especially if the rolls of a roll unit formed by a pair of soft rolls and a hard roll cooperating with them are arranged at least substantially in the same plane, which preferably is perpendicular to the plane formed by the hard rolls of the roll stack. Thereby a counterbalance between the lateral forces in the calender is obtained without any influence on the nip pressure of the hard rolls.

Due to limitations regarding the available space or for any other reason the roll stack formed by the hard rolls can be divided into units separated from each other if so required.

The invention is illustrated in the attached drawings, in which

Figure 2:
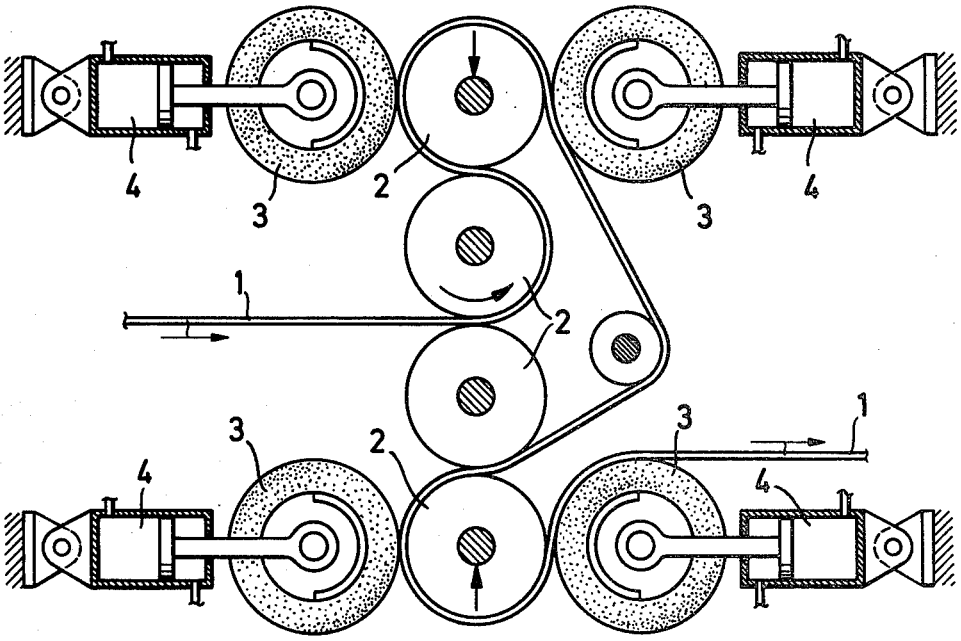
Figure 3:
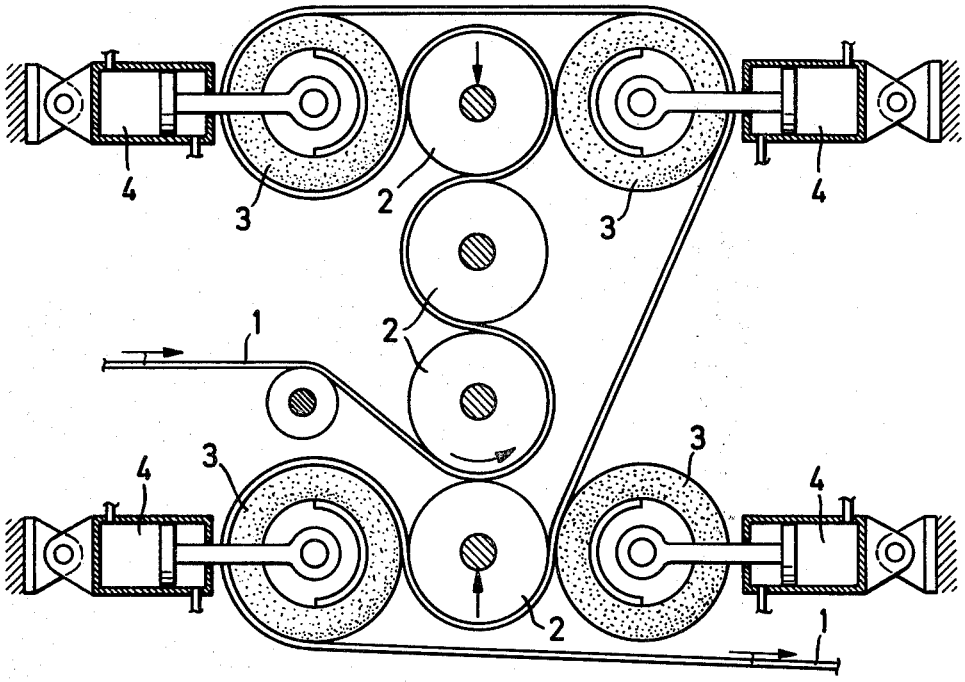
Figure 4:
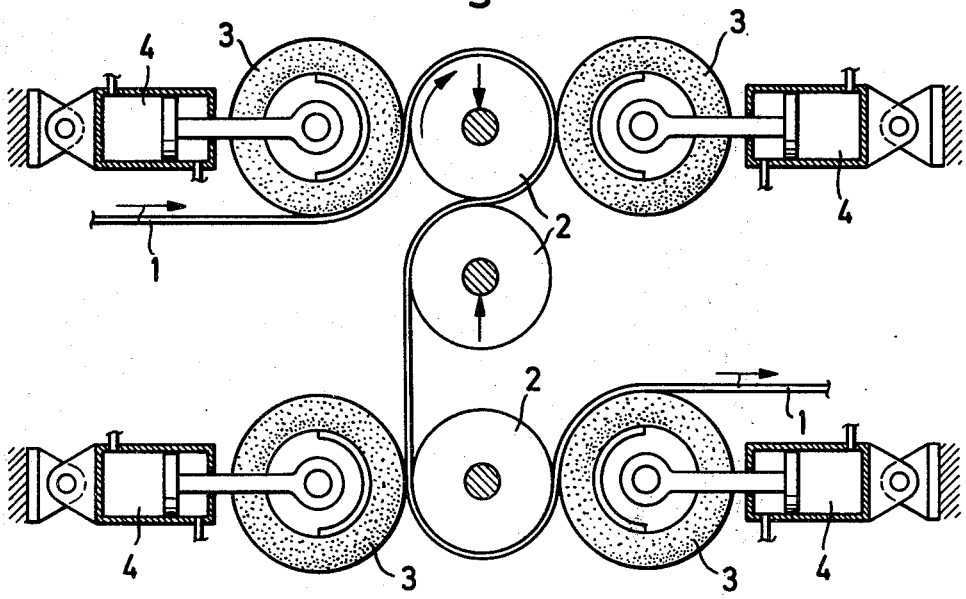

FIG. 1 shows a schematical view of a calender according to the invention and a web passing alternative appliable thereto, FIG. 2 shows another web passing alternative in a similar calender, FIG. 3 shows a third web passing alternative in a similar calender, and FIG. 4 shows a calender according to the invention wherein the hard rolls have been divided into two separate units.

In the drawings, 1 indicates a paper web or the like, which is passing through hard nips formed between hard steel/rolls 2 and through soft nips formed between hard rolls 12 and soft rolls 3. To obtain the required nip pressure in the soft nips the soft rolls 3 are loaded from the side by suitable loading means, for example, by hydraulic cylinders 4 or the like. In the calenders according to the invention shown in the Figures, the soft rolls 3 can be made considerably bigger than the hard rolls 2, whereby an advantageous calendering is obtained in the soft nips. Due to the roll arrangement, lateral deflection does not occur in the hard rolls, where by the operation of the calender is improved.

In the web passing alternative shown in FIG. 1, the web is first treated in a super calender phase, where one side of the web is glazed in two successive soft nips against a hard roll. Thereafter, the web is calendered in three hard nips, which are followed by another super calender phase, where the other side of the web is glazed in two soft nips against a hard roll. The result might, however, be asymmetric, because calendering in hard nips is arranged to precede supercalendering in soft nips of only one side of the web. In the alternative show in FIG. 2, this has been corrected by having two hard nips followed by two soft nips glazing one side of the web and then a hard nip and finally two soft nips glazing the other side of the web. In the alternative shown in FIG. 3, calendering is first performed in three hard nips and thereafter a successive supercalendering of both sides of the web takes part. As regards the calendering operation, this alternative comes closest to the prior art. In the embodiment shown in FIG. 4, the roll stack has been divided into two separate units. Additional hard nips can be obtained when needed by adding a number of hard rolls to one of the roll units or between the units so as to form a third unit.

The invention is not limited to the embodiments shown, but several modifications thereof are feasible within the scope of the attached claims.

I claim:

1. A calender being defined by a plurality of superimposed hard rolls and a number of soft rolls arranged to laterally load at least two of said hard rolls, said soft rolls being arranged in pairs formed by two soft rolls opposite each other at both sides of the same hard roll, those of said rolls which are located between a pair of soft rolls being arranged so that the distance between their axes is greater than the sum of their respective radii.

2. A calender as claimed in claim 1, wherein: said superimposed hard rolls form a roll stack including, between those of said hard rolls which are located between a pair of soft rolls, at least one other hard roll, forming a roll nip together with an adjacent hard roll.

3. A calender as claimed in claim 2, wherein: the axes of at least one of said pairs of soft rolls being arranged in a plane substantially at right angles to a plane through the axes of the hard roll between said pair of soft rolls and an adjacent hard roll.

4. A calender as claimed in claim 1, wherein said hard rolls form a plurality of separate roll nip including units.

* * * * *